US007334535B1

(12) United States Patent
Somers et al.

(10) Patent No.: US 7,334,535 B1
(45) Date of Patent: Feb. 26, 2008

(54) FLAGPOLE ORNAMENT

(75) Inventors: James Scott Somers, Dallas, TX (US); Bruce A. Wyatt, Garland, TX (US)

(73) Assignee: Concord Industries, Inc., Addison, TX (US)

( * ) Notice: Subject to any disclaimer, the term of this patent is extended or adjusted under 35 U.S.C. 154(b) by 0 days.

(21) Appl. No.: 11/513,560

(22) Filed: Aug. 31, 2006

(51) Int. Cl.
*G09F 17/00* (2006.01)

(52) U.S. Cl. ..... 116/173; 403/25

(58) Field of Classification Search ..... 116/173, 116/174, 175; 403/25, 310, 312, 344; 428/28
See application file for complete search history.

(56) References Cited

U.S. PATENT DOCUMENTS

| | | | | | |
|---|---|---|---|---|---|
| 302,665 | A | * | 7/1884 | Munger et al. | 403/25 |
| 674,792 | A | * | 5/1901 | McGrath et al. | 116/174 |
| 696,534 | A | * | 4/1902 | Assel | 428/28 |
| 737,142 | A | * | 8/1903 | Richards | 403/25 |
| 857,658 | A | * | 6/1907 | Newell | 403/25 |
| 1,048,291 | A | * | 12/1912 | Buckley | 116/174 |
| 1,061,041 | A | * | 5/1913 | Buckley | 116/174 |
| 1,124,656 | A | * | 1/1915 | Prather | 116/173 |
| 1,748,625 | A | * | 2/1930 | Troth | 116/173 |
| 1,855,824 | A | * | 4/1932 | Crichton | 116/173 |
| 2,072,573 | A | * | 3/1937 | Vigliotti | 116/173 |
| 2,662,324 | A | * | 12/1953 | Granacher | 403/25 |
| 3,124,000 | A | * | 3/1964 | Morley | 116/173 |
| 3,948,210 | A | * | 4/1976 | Van Rijn | 116/173 |
| 3,952,695 | A | * | 4/1976 | Vollstedt | 116/173 |
| 4,407,601 | A | * | 10/1983 | Reeder | 403/25 |
| 4,907,907 | A | * | 3/1990 | Kreusel | 403/171 |
| 5,572,835 | A | * | 11/1996 | Atkins et al. | 52/111 |

OTHER PUBLICATIONS

Catalog No. 2, Flagpole Components, Inc., copyright 1992.

* cited by examiner

*Primary Examiner*—R. Alexander Smith
(74) *Attorney, Agent, or Firm*—Gardere Wynne Sewell LLP

(57) ABSTRACT

A flagpole ball ornament comprising opposed, hollow, hemispherical parts interfitted to each other at a circular rim formed on one of the parts and interconnected by an elongated diametral rod-like brace member. The brace member is internally threaded at opposite ends for receiving a machine screw to connect one of the hemispherical parts to the brace member and the opposite end of the brace member receives an all-thread member for connecting the ball to a support post member. The brace member may include, alternatively, a bolt clearance bore for receiving an elongated bolt for connection to the post member.

13 Claims, 2 Drawing Sheets

FLAGPOLE ORNAMENT

BACKGROUND OF THE INVENTION

In the art of flagpole ornaments, including spherical ornaments or balls, there has been a continuing need to provide ornaments which are durable, easy to install, easy to modify for various flagpole upper brackets or trucks, which have requisite strength in use and during installation and are economical to manufacture. These requirements, collectively, have been difficult to meet in prior art flagpole ornaments, particularly spherical ornaments or so-called flagpole balls. For example, a problem with prior art flagpole ball ornaments is that, for ornaments which are constructed of two hemispherical parts, the parts typically become at least partially separated wherein one of the hemispherical parts becomes skewed or rotated relative to the other part. Still further, prior art flagpole ball ornaments are also, typically, prone to separating or becoming disassembled wherein one or more parts may fall to the ground. Thermal stresses, other environmental factors and vibration of the pole all contribute to early failure of prior art flagpole ball ornaments. The present invention has been developed to overcome the deficiencies and failures associated with prior art flagpole ornaments, generally of the type described herein.

SUMMARY OF THE INVENTION

The present invention provides an improved flagpole ornament, particularly an ornament mounted at the top or peak of a flagpole and, more particularly, a spherical ornament or flagpole ball.

In accordance with one aspect of the present invention, an improved flagpole ball is provided which comprises opposed hemispherical ornament parts which are cooperable in assembly to provide a flagpole ball and which may be easily formed of a durable and corrosion resistant metal, such as aluminum. The opposed hemispherical ornament parts are supported in assembly with each other by a generously proportioned circumferential rim formed on one of the hemispherical parts. Thanks to the generous proportions of the height of the rim and the provision of a spacer or internal brace member, a flagpole ball ornament in accordance with present invention has a significantly reduced possibility of the hemispherical parts becoming separated while in their working positions.

In accordance with another aspect of the present invention, the hemispherical ornament parts are advantageously retained in assembly with each other by the aforementioned elongated internal brace member which is engaged with the hemispherical parts along a diametral axis and the hemispherical parts are secured to the brace member by threaded fasteners including, preferably, steel fasteners which are secured with a thread locking composition, for example.

In one embodiment, the internal brace member is provided with opposed threaded bores for receiving a steel bolt and/or machine screw at one end and a continuous threaded member at the other end and which is provided to connect the ornament to a post or column member mountable on an upper flagpole bracket or so-called truck member. In an alternate embodiment the brace member is provided with a clearance bore or passage for receiving a single elongated bolt having a conventional head and adapted to threadly engage the column or post member. The post member is provided with an internally threaded bore at one end for connection to the continuous threaded member or bolt and an externally threaded part at its opposite end for the threaded engagement with the pole upper bracket or truck member. The post may be interchanged with other post members for accommodating different sizes of threaded bores or tapped holes in respective truck members.

In accordance with yet a further aspect of the invention a novel flagpole ball assembly is provided which is durable in use, corrosion resistant, easy to assemble and economical to manufacture.

Those skilled in the art will further appreciate the. advantages and superior features of the flagpole ornament of the present invention upon reading the detailed description which follows in conjunction with the drawing.

DETAILED DESCRIPTION OF PREFERRED EMBODIMENTS

Figure 2:
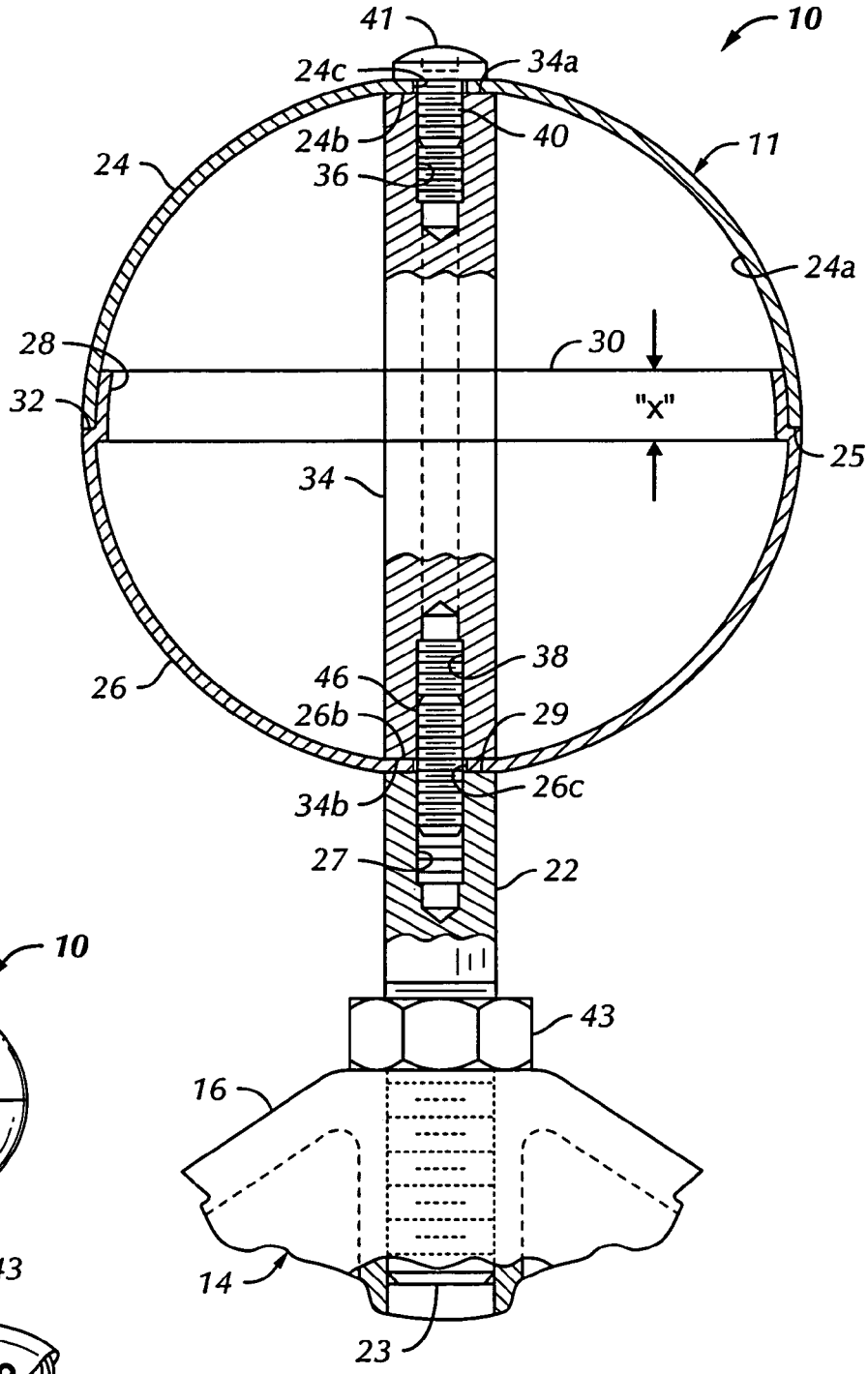
FIG. 2 is a longitudinal central section view of the flagpole ornament shown in FIG. 1.

In the description which follows, like parts are marked throughout the specification and drawing with the same reference numerals, respectively. The drawing figures are not necessarily to scale and certain elements may be shown in somewhat schematic form in the interest of clarity and conciseness.

Figure 1:
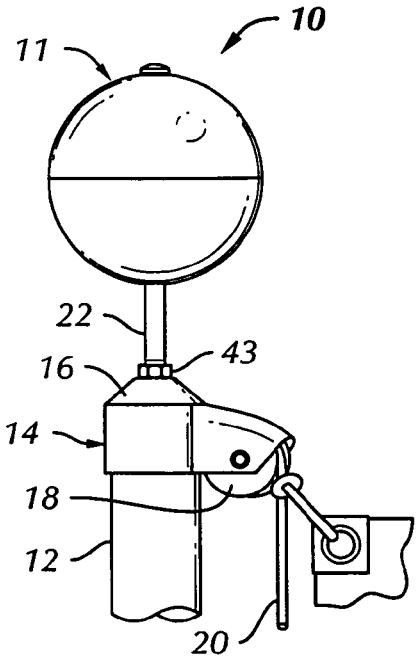
FIG. 1 is a detail view of an improved flagpole ornament shown mounted on an upper bracket or truck member of a flagpole.

Referring to FIG. 1, there is illustrated a flagpole ornament in accordance with the invention and generally designated by the numeral 10. The flagpole ornament 10 is illustrated mounted on the peak of a vertical oriented flagpole 12 having a conventional upper bracket or truck assembly 14 suitably mounted thereon. Truck assembly 14 includes a somewhat inverted cup-shaped truck member 16 mounted on the peak of flagpole 12 in a conventional manner and supporting a conventional rotatable pulley 18 over which is trained a flag halyard 20. Flagpole ornament 10 is characterized as a generally spherical member or ball 11 and includes an upstanding post member 22 suitably connected to the truck member 16 as will be described in further detail herein.

Referring now to FIG. 2, the flagpole ball 11 is characterized by opposed hollow, shelllike, hemispherical parts 24 and 26 which are interengaged to form a substantially spherical member. Hemispherical parts 24 and 26 are each, preferably formed of relatively thin-walled aluminum, for example, and are fabricated in a conventional manner by suitable forming technique, known to those skilled in the art. However, hemispherical ornament part 26 includes a slightly radially inwardly displaced circular rim 28 delimited by a circumferential edge 30 and dimensioned to fit snugly within and engaged with the inside wall 24*a* of part 24, as illustrated. The radially inwardly displaced rim 28 provides an annular shoulder 32 which is adapted to engage circumferential edge 25 of part 24 in a snug-fitting relationship to form the spherical ball member 11.

Ball member 11 is held in assembly and strengthened against deformation by an internal diametral column or brace member 34 preferably comprising a cylindrical aluminum rod which is provided with opposed axially extending internally threaded bores or tapped holes 36 and 38, as shown. Hemispherical part 24 is preferably somewhat flattened at a circular portion 24*b* opposite another somewhat flattened circular portion 26*b* of part 26. Parts 24 and 26 are also provided with fastener receiving openings 24*c* and 26*c*, respectively. A pan-head machine screw 40 is operable to be inserted through opening 24*c* and threadedly engaged with brace member 34 at threaded bore 36, as shown, for securing part 24 to brace member 34.

Referring further to FIG. 2, ornament post member 22 includes an externally threaded end part 23 which is shown threadedly engaged with truck member 16 and suitably locked in engagement therewith by a conventional hex-shaped locknut 43. The opposite end of post member 22 includes an internally threaded bore 27 opening to a transverse end-face 29 of post member 22 which is engageable with the flattened part 26*b* of hemispherical ornament part 26. An externally, continuous threaded or "allthread" fastener member 46 extends through opening 26*c*, is threadedly engaged with brace member 34 at threaded bore 38 and is threadedly engaged with post member 22 at threaded bore 27. Fastener member 46 is preferably formed of steel while post member 22 and, as mentioned previously, brace member 34 are preferably formed of aluminum. Generally planar transverse end faces 34*a* and 34*b* of brace member 34 are tightly engaged with the respective flattened or planar circular portions 24*b* and 26*b* of the hemispherical parts 24 and 26. Accordingly, the head 41 of fastener 40 may be in complete area contact with a surface of the hemispherical part 24 and the end-face 29 of post member 22 is also in substantially total area contact with the flattened or planar portion 26*b* of hemispherical part 26. In this way, upon assembly of the ornament 10, the brace member 34 is in engagement with the hemispherical parts 24 and 26 over relatively large areas to distribute stresses thereon while aiding in maintaining the assembly as a consequence of tightening the fastener 40 and tightening the post 22 against hemispherical part 26, thanks to the allthread fastener member 46. Still further, the flagpole ornament 10 may advantageously utilize thread locking and sealant compositions-coated on the cooperating threads of the brace member 34 and the fasteners 40 and 46, including a thread locking composition available under the trademark LOCTITE, for example.

Figure 3:
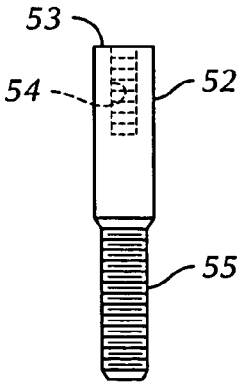
FIG. 3 is a side elevation of an alternate embodiment of a post member for use with the ornament shown in FIGS. 1 and 2.

Referring briefly to FIG. 3, an alternate embodiment of a post member for use with the ornament 10, in place of post member 22, is illustrated and generally designated by the numeral 52. Post member 52 includes a transverse end face 53, an internally threaded bore 54 and an axially extending externally threaded part 55 which may be of a different thread size than the threaded portion 23 of post member 22. In this way, post members may be interchanged as required by the particular flagpole upper bracket or truck member to which the ornament 10 is to be connected.

As previously mentioned, parts 24 and 26 are preferably formed of relatively thin-walled aluminum. For a ball diameter of about 4.0 inches, the wall thickness may be about 0.030 inches and the height "×" of the rim 28, FIG. 2, is preferably about 0.38 to 0.50 inches. The brace member 34 and the post members 22 or 52 may be formed of aluminum cylindrical rod having a diameter of about 0.625 inches. The overall length of the post members 22 and 52 may be about 4.0 inches with the externally threaded portions being about 2.0 inches and the internally threaded portions 27 and 54 being about 1.0 inch deep and being of a thread size 5/16-18NC, for example. The allthread faster member 46 is preferably at least about 1.0 inches to 2.0 inches in length. Fabrication and assembly of the ornament 10, based on the foregoing description, is believed to be within the purview of one skilled in the art.

Figure 4:
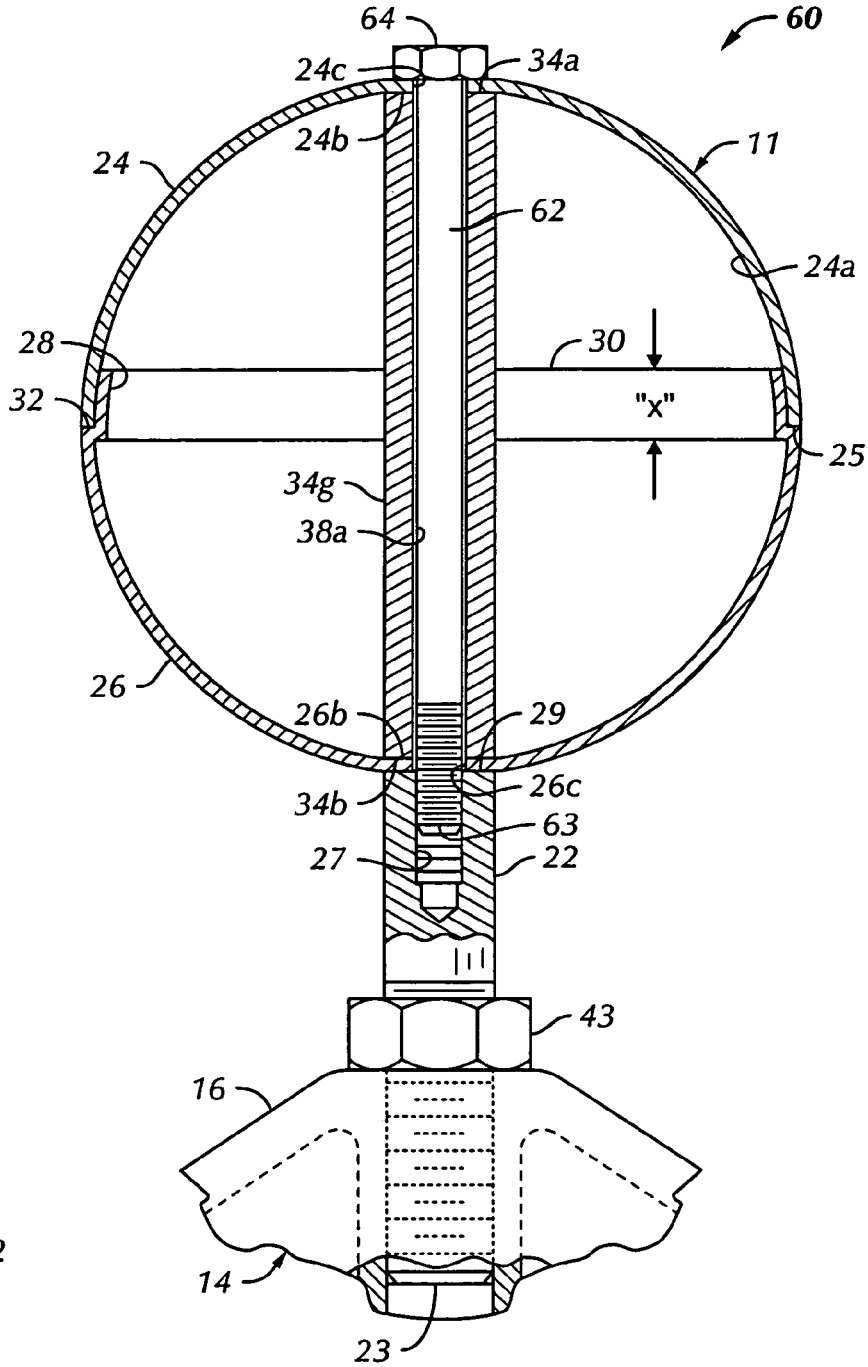
FIG. 4 is a longitudinal central section view of an alternate embodiment of a flagpole ornament in accordance with the invention.

Referring now to FIG. 4, another embodiment of a flagpole ball ornament in accordance with the invention is illustrated and generally designated by the numeral 60. The flagpole ornament 60, utilizes the components of the flagpole ball ornament 10, as indicated in FIG. 4, including the opposed hemispherical parts 24 and 26 and the post or column member 22. However, the internal brace member 34 has been replaced by a similar brace member 34*g*, which is provided with a fastener clearance bore 38*a* for receiving an elongated machine screw or bolt 62 having a distal threaded portion 63 engageable with threaded bore 27 of post member 22. Brace member 34*g* also includes the opposed transverse end faces 34*a* and 34*b*. Machine screw or bolt 62 includes a conventional hexhead 64 and is of a diameter slightly less than the diameter of the bore 38*a*. Accordingly, fastener 62 comprising the hexhead machine screw or bolt is operable to secure the hemispherical parts 24 and 26 tightly together and braced by the brace member 34*g* and further wherein a single fastener may be utilized to secure the ball ornament to the post or column member 22. When assembling the flagpole ornament 60, a thread locking and sealant composition as mentioned hereinabove is preferably used on the threads of the threaded shank part 63 and/or the bore 27. The brace member 34*g* may, in fact, be identical to the brace member 34 except for the bore 38*a*, which may be of the same diameter as required for pre-drilling the brace member 34 to accommodate the threaded bores 36 and 38 when such bores are tapped in the brace member 34.

Although preferred embodiments of the invention have been described in detail herein, those skilled in the art will recognize that various substitutions and modifications may be made without departing from the scope and spirit of the appended claims.

What is claimed is:

1. A flagpole ornament comprising:

opposed ornament parts configured for engagement with each other at cooperating portions of each;

an internal brace member extending between and engaged with said ornament parts, respectively, said brace member including fastener receiving means for receiving fastener means for securing said brace member to said ornament parts; and a post member adapted to be connected to a flagpole bracket or truck at one end and connected to said fastener means to form said flagpole ornament, wherein said brace member includes an elongated bore extending therethrough and said fastener means includes an elongated bolt extending through said bore and connected to said post member for securing said ornament parts to each other and to said post member.

2. The ornament set forth in claim 1 wherein:

said ornament parts are substantially hemispherical shaped.

3. The flagpole ornament set forth in claim 2 wherein:

one of said ornament parts includes a circular rim portion configured to fit within and engaged with an inner wall of the other of said ornament parts.

4. The flagpole ornament set forth in claim 1 wherein:

said brace member includes an elongated rod internally threaded at opposite ends for receiving an externally threaded screw at one end connecting one of said parts to said brace member and for receiving a threaded member at an opposite end for connecting said ornament to said post member, respectively.

5. The flagpole ornament set forth in claim 1 wherein:

said post member is internally threaded at one end and externally threaded at an opposite end for mounting said ornament on a flagpole bracket.

6. The flagpole ornament set forth in claim 5 wherein:

said post member is interchangeable with another post member having an externally threaded portion of different thread size.

7. A flagpole ornament comprising:

opposed hemispherical ornament parts configured for interengagement with each other at cooperating portions of each;

an internal brace member extending between and engaged with said ornament parts, respectively, said brace member including, at opposite ends thereof, fastener receiving bores for receiving an externally threaded screw for connecting one of said parts to said brace member and for receiving an allthread member at an opposite end of said brace member; and a post member operable to be connected to a flagpole bracket or truck at one end and to said allthread member at an opposite end wherein said post member serves to secure said ornament parts to each other.

8. The flagpole ornament set forth in claim 7 wherein:

one of said ornament parts includes a circular rim portion configured to fit within and engaged with an inner wall of the other of said ornament parts.

9. The flagpole ornament set forth in claim 7 wherein:

said post member is internally threaded at one end and externally threaded at an opposite end for mounting said ornament on said flagpole bracket or truck.

10. The flagpole ornament set forth in claim 9 wherein:

said post member is interchangeable with another post member having an externally threaded portion of different thread size.

11. A flagpole ball ornament comprising:

opposed, hollow, substantially hemispherical ornament parts configured for interengagement with each other along cooperating portions of each, including a circular rim on one of said parts engaged with an inner wall of the other of said parts;

an elongated rod internal brace member extending between and engaged with said ornament parts, respectively, said brace member including a fastener receiving bore extending axially entirely through said brace member for receiving an externally threaded bolt;

a post member adapted to be connected to a flagpole bracket or truck at one end; and an elongated bolt extending through said bore in said brace member and threadedly engaged with said post member for securing said parts in assembly with each other and with said post member to form said flagpole ornament.

12. The flagpole ornament set forth in claim 11 wherein:

said post member is externally threaded at an opposite end for mounting said ornament on said flagpole bracket or truck.

13. The flagpole ornament set forth in claim 12 wherein:

said post member is interchangeable with another post member having an externally threaded portion of different thread size.

* * * * *